US005365225A

United States Patent [19]

Bachhuber

[11] Patent Number: 5,365,225

[45] Date of Patent: Nov. 15, 1994

[54] TRANSMITTER-RECEIVER SYSTEM WITH (RE-)INITIALIZATION

[75] Inventor: Anton Bachhuber, Langquaid, Germany

[73] Assignee: Siemens Aktiengesellschaft, Munich, Germany

[21] Appl. No.: 773,635

[22] PCT Filed: Apr. 6, 1990

[86] PCT No.: PCT/DE90/00276

§ 371 Date: Nov. 18, 1991

§ 102(e) Date: Nov. 18, 1991

[87] PCT Pub. No.: WO90/14484

PCT Pub. Date: Nov. 29, 1990

[30] Foreign Application Priority Data

May 18, 1989 [DE] Germany ..... 3916175

[51] Int. Cl.[5] ..... E05B 49/00; G07C 9/00

[52] U.S. Cl. ..... 340/825.31; 340/825.72; 380/21; 380/28; 380/48

[58] Field of Search ..... 340/825.31, 825.69, 340/825.72, 825.3; 380/21, 28, 37, 43, 48

[56] References Cited

U.S. PATENT DOCUMENTS

| | | | |
|---|---|---|---|
| 4,596,985 | 6/1986 | Bongard et al. . | |
| 4,686,529 | 8/1987 | Kleefeldt . | |
| 4,723,121 | 2/1988 | van den Boom et al. . | |
| 4,758,835 | 7/1988 | Rathmann et al. | 340/825.31 |
| 4,847,614 | 7/1989 | Keller . | |
| 4,928,098 | 5/1990 | Dannhaeuser | 340/825.31 |
| 5,103,221 | 4/1992 | Memmola | 340/825.31 |
| 5,144,667 | 9/1992 | Pogue, Jr. et al. | 340/825.31 |

FOREIGN PATENT DOCUMENTS

| | | |
|---|---|---|
| 0265728 | 5/1988 | European Pat. Off. . |
| 0292217 | 11/1988 | European Pat. Off. . |
| 3225754 | 1/1984 | Germany . |
| 3244049 | 9/1984 | Germany . |

*Primary Examiner*—Michael Horabik

*Attorney, Agent, or Firm*—Hill, Steadman & Simpson

[57] ABSTRACT

A transmitter-receiver system (FIGS. 1 and 2), which checks the authorization to use an object (O), contains a transmitter (S), which has a transmitting element (SE) as well as one or more transmitter operator control elements (SB), which for their part can trigger the transmitting of coded signals (SI), the code concerning authorization to use the object (O). The transmitter (S) has at least a single transmitter memory (SS) for the storage of data on use authorizations. The receiver (E) has a receiving element (EE), which receives the coded signals transmitted to it, and a receiver memory (ES) for the storage of data for determining the authorization of codes (SI) received, and also a logic circuit (μP), which checks the respectively received code (SI) by means of the data stored in the receiver memory (ES) and, depending on the result of the check actuates a mechanism (ST). For (re-)initialization, the transmitter (S) contains for preparation of a new future code/set of codes (SI) a random generator (Z), which generates a random number (B) by actuation of at least one of the transmitter operator control elements (SB). The transmitter (S) transmits to the receiver (E) an original code (UC) without any dialog taking place automatically and bidirectionally between the transmitter (S) and the receiver (E).

44 Claims, 1 Drawing Sheet

TRANSMITTER-RECEIVER SYSTEM WITH (RE-)INITIALIZATION

BACKGROUND OF THE INVENTION

The transmitter-receiver system according to the invention was in fact developed for remote control of the central locking system of a motor vehicle and consequently concerns a locking system actuated electronically or optically by means of coded signals. However, in principle it is additionally suitable for remote controls of whatever kind in which a control code (generally as difficult to copy as possible) is transmitted from a transmitter to a receiver. Thus, the invention is also suitable for the actuation of, for example (garage) doors and other closing and opening mechanisms, but also for example for the remote-controlled starting, stopping, switching, igniting, steering etc. of, in principle, any objects.

At the same time, the invention relates to a problem in initializing and re-initializing the transmitter-receiver system, as soon as it is namely intended to establish finally the code or a corresponding set of codes permitting actuation of the mechanism. When so doing, the code or the set of codes established is in each case to be sufficiently complicated and as difficult as possible for unauthorized persons to reproduce.

The invention namely relates to a further development of the specific transmitter-receiver system which is already known per se, in particular from DE-A1-32 25 754.

In the case of such a known system, an original code for the first-time initialization and also later in each case for a (renewed) re-initialization is generated and stored by the user of the system or by an authorized expert in a largely automatically controlled dialog between the transmitter and the receiver.

However, the initialization and re-initialization of the known transmitter-receiver system based on such a dialog requires relatively elaborate design measures and relatively complicated control processes.

In addition, a similar system is known from EP-A-0 292 217, (corresponding to U.S. Pat. No. 4,881,148), in which system the transmitter namely contains for preparation of the new code used in future by itself a random generator, which generates a random number. In addition, the transmitter transmits to the receiver in a unidirectional way, that is to say without a dialog taking place automatically and bidirectionally between the transmitter and the receiver, an original code, which for its part accordingly establishes the starting code, that is to say the new code, this transmitted original code being stored in the transmitter memory or in the receiver memory.

Other measures for (re-)initializing are likewise known or conceivable:

Associated sets of receivers (for example keys) and receivers with appropriately fixed preprogramming can be supplied by the manufacturer, which however requires careful stock keeping, and in general always the purchase of a complete set, even if for example only one transmitter or only one receiver is to be exchanged owing to defects.

Similar sets can also be produced which are not initialized until later by the authorized motor vehicle dealer by subsequent programming in an inconvenient way, namely by means of special devices.

In the case of a system with a fixed, unchanging code, the starting code represents the fixed code used all the time by the authorized person for actuation of the mechanism. In the case of a system with a changing code, however, the code representing authorization is constantly changed during the course of operation of the transmitter-receiver system on the basis of an algorithm which is also stored, so that then the original code establishes in particular that starting code which represents the first code which can be used by an authorized user for actuation of the mechanism. Subsequent authorized codes are occasionally called continuation codes. A changing code with constantly new, never recurring continuation codes offers much greater protection against misuse of the object, for example the motor vehicle, than a fixed code.

SUMMARY OF THE INVENTION

The invention should achieve a whole catalog of advantages.

It is an object of the present invention to be able to use a very long original code, or a comparatively very long original code, derived by converting from a plurality of random numbers, although the technical outlay for the generation of random numbers, in particular the outlay for the random generator, is to be particularly small, the security against unauthorized use of the object namely being that much greater the more complicated, that is longer, the original code to be transmitted is.

It is an object of the present invention consequently to permit a high level of security against unauthorized use of the system, by it being very unlikely that, after initializing or after re-initializing, the code accepted by the receiver or the set of codes accepted by the receiver can be generated by chance by an unauthorized third party. This is because the code authorizing use or the corresponding set of codes is established beforehand sufficiently randomly from a very large number of possible codes during the course of (re)initialization, It is an object of the present invention, to allow the user as little operating effort as possible, by allowing each and every user, that is to say not only the manufacturer of the system or of the object and/or a person authorized by him, for example the dealer, but also the purchaser, to (re-)initialize the system at any time in a very simple way. This is provided in any event that he already has the transmitter belonging to the system concerned and knows how he has to operate the system.

It is an object of the present invention to allow that, in any event in principle, not only either a changing code or only a fixed code can be initialized, but that, if need be, even a mixed code can be (re-)initialized, by it then being possible for both a fixed code and a changing code to be (re-)initialized (for which purpose the person concerned can enter into the transmitter-receiver system, for example, initially a starting code individually assigned to the object concerned and/or also can enter into the transmitter and receiver the additional code described later) which may then even be a fixed code (for example to prevent theft of individual original keys and/or original receivers from the sales premises of the dealer, and/or in order to prevent the theft of an object by means of a transmitter belonging to another object by unauthorized (re-)initialization of the object) although all later re-initializations of the object concerned can be carried out in the way according to the invention by the authorized user/purchaser himself.

It is an object of the present invention that no automatic dialog is to be required between transmitter and receiver during (re-)initializing.

The invention is a transmitter-receiver system which checks the authorization to use an object, for example, to actuate the central locking system of a motor vehicle, with a transmitter, for example, an electronic motor vehicle key. The transmitter has a transmitting element, for example, a VHF antenna, ultrasonic radiator and/or infrared radiator, as well as, one or more transmitter operator control elements, which for their part can trigger the transmitting of coded signals, the code concerning the authorization to use the object. The transmitter also has at least a single transmitter memory for the storage of data on use authorizations. The system further has a receiver, for example, fitted underneath the motor vehicle roof, which has a receiving element, for example, an ultrasonic microphone and/or infrared photo-diode, which receives the coded signals transmitted to it. The receiver has a receiver memory for the storage of data for determining the authorization or non-authorization of codes received, and a logic unit, which checks the respectively received code by means of the data stored in the receiver memory and, depending on the result of the check, actuates or does not actuate a mechanism, for example, a motor vehicle central locking system and/or a motor vehicle break-in alarm system. In the system for (re-)initialization, that is for initialization and/or for re-initialization, i.e. for matching and/or rematching between a new code transmitted in the future by the transmitter and the code accepted in the future as authorized by the receiver, the transmitter contains for preparation of the new code/set of codes used in the future by itself a random generator, which in each case generates a random number by actuation of at least one of the transmitter operator control elements, in transmits from the transmitter to the receiver in original code. The transmitter either establishes the starting code, that is the new code or, in the case of a changing code, the set of various new codes (=set of codes) including the starting code, that is including the first usable code of this set, by this transmitted original code, and/or data formed in the receiver and/or in the transmitter from the original code by converting, for example a starting code formed by converting, being stored in the transmitter memory or in the receiver memory. The random generator in each case generates only a fragment, formed by the random number, of a code by generating in stages, by further actuations of at least one of the operator control elements, also the remaining fragments. A logic unit in the transmitter converts the generated fragments into the original code to be transmitted. The original code or starting code is derived from at least three, for example, five or eight fragments of, for example, eight bits each interleaved or not interleaved with one another, in each case generated by means of the random generator. This original code is transmitted unidirectionally from the transmitter to the receiver, that is, without any dialogue taking place automatically and bidirectionally between the transmitter and the receiver.

In spite of the simplicity of the technical design, in spite of the simplicity of operator control and in spite of the high level of security against unauthorized use which can be achieved, in the case of the invention it is not necessary to fit additionally in the transmitter a receiving circuit for a transmitter-receiver dialog. Also as a rule it is not necessary to use special devices for re-initializing, even for first-time initializing, or to trouble the dealer to initialize the system for a customer. Thus, the invention is not rigidly restricted to the fact that only the later authorized user/purchaser can initialize the system for a fixed code or for a changing code.

Thus, the invention is also suitable for (re-)initializing a transmitter-receiver system with a fixed code by the authorized transmitter user. It is also suitable, however, to be precise in fact particularly highly suitable, for (re-)initializing a transmitter-receiver system with a changing code, to be precise the algorithm on the basis of which the code is changed can in fact be virtually arbitrary in principle. For further increasing protection against misuse the original code can even itself change the algorithm on the basis of which the code is changed, by for example one or more bits of the original code converting an adding command of the algorithm into a multiplying command. The original code can, in principle, differ from the starting code, for example in order to increase the security that no unauthorized person can readily actuate the mechanism, even if he has been able to record the original code by listening in.

Thus, the transmitter contains a random generator, which forms the original code in one operation as a complete code or in stages, or which forms a code (for example the starting code itself), or a series of code fragments, from which code/fragments the original code to be transmitted is only formed by converting/enciphering. This original code is subsequently transmitted (as a complete code in one operation or in stages) to the receiver, the receiver being able to use this original code directly, or a code derived from it on the basis of a deciphering algorithm, as starting code. As specified above, this starting code thus represents the fixed code (or in the case of a changing code a first authorizing code from the set of authorizing codes) which an authorized person can thus transmit for use of the object (for example motor vehicle) by means of a transmitter (electronic key).

The additional measures specified below allow additional advantages to be achieved.

A display, for example a small lamp, is controlled by a clock generator, which display stipulates for operator prompting during (re-)initializing a clock for actuation, for example for pressing and/or releasing, the transmitter operator control element(s), in order during these clocks to generate by stages the original code or starting code by means of the random generator. This provides reliable operator prompting, which safeguards against an original code being transmitted by the transmitter unintentionally due to chance actuations of the operator control element(s), in particular if the clock is very irregular.

The clock generator and consequently the display stipulates in an uneven clock time periods in which a fragment can be generated and/or transmitted by means of appropriate actuation of the operator control element concerned. This provides a high level of security that no unauthorized user inadvertently generates fragments and consequently an original code if he inadvertently actuates operator control elements.

The time periods do not begin until after a stipulated delay, of for example one second, after the display, and the time periods are limited to a stipulated maximum duration, of for example three seconds. This increases further the level of security against unauthorized or unintentional misoperations.

The transmitter stores either these various fragments directly, or fragmental values indirectly, formed from these fragments according to an algorithm, for establishing the new code/set of codes in its transmitter memory, in order to put together these fragments or values to form the original code and/or staring code and transmit the original code only after an appropriate actuation of at least one of its transmitter operator control elements. This provides progressively to make all the preparations for transmitting the original code, in order to be able to transmit the original code quickly and completely to the receiver at a convenient time, when no unauthorized third party is in the vicinity.

The original code is transmitted in stages, and each stage is triggered by actuation of the transmitter operator element concerned. This increases the level of security against unauthorized listening in to the transmitting original code, that an unauthorized third party can at most listen in to parts of the code, of little use to him, but not readily listen in to the entire original code.

With appropriate actuation of at least one of its transmitter operator control elements, the transmitter transmits the original code as a complete code in a block. This increases the level of security against mis-operations of the transmitter, in particular to increase the probability that all the bits of the original code are transmitted with approximately the same power to the transmitter.

The display in the transmitter and a display in the receiver, indicates that all the fragments have been generated and transmitted. This makes it easier for the user, by a display, to gain the certainty that the (re-)initialization is satisfactorily complete.

The transmitter operator control element used for generating and the transmitter operator control element used in normal operation for transmitting the respective code are identical, so that with each actuation of the transmitter operator control element concerned a fragment is in each case newly generated, and the respectively generated fragment is buffer-stored in reserve, as such or code-converted, in the transmitter memory directly, that is before a next actuation of the transmitter operator control element concerned. This reduces the effort for preparation of re-initialization, for the user, by it being possible even during normal operation to obtain random numbers as fragments to be used later, the time required for preparing re-initialization additionally being reduced whenever a re-initialization is to be carried out later (possibly in very great haste) and consequently, in such cases of haste, the level of security against unauthorized use, for example security against theft, is increased.

An additional code, for example six particular additional bits, indicating initializing or re-initializing, is added to the original code transmitted, in order to inform the receiver that then an original code is being transmitted. This initiates the transmission of the original code in an uncomplicated way and increase the functional reliability of the transmitter-receiver system during (re-)initializing.

A fragment of the original code or the entire original code is transmitted directly together with the additional code. This increases the reliability and simplicity of operator control during (re-)initializing, inter alia because the power with which the individual bits of the original code are transmitted is then approximately equally great and because the transmission requires particularly little time.

The clock generator and the display are fitted in the transmitter and the display stipulates with which clock the fragments are to be generated by stages. This prevents unwanted generation (or even transmission) of the original code with a very high degree of probability, even if unauthorized persons play around with the transmitter, and to require for this a particularly low outlay on components, in particular if a display, for example a power-saving LCD display, is in any case already fitted to the receiver for other reasons, for example in order to display its operational readiness.

The clock generator is fitted in the transmitter and/or in the receiver, and the display is fitted in the receiver, and the display stipulates with which clock an original code fragment is in each case to be transmitted in stages by actuation of the transmitter operator control element(s) concerned. This prevents unwanted (re-)initialization of the system by such menu prompting, displayed by the receiver, by transmissions of an original code not triggered by the receiver having no (re-)initializing effects, as well as to avoid the weight and outlay for fitting a display in the transmitter and, in addition, to share the use of a display on the receiver, often already fitted for other reasons, for example the display of a theft alarm system.

The receiver only carries out the (re-)initialization effectively if the authorized person additionally carries out and/or has carried out an additional measure, for example the additional measure of "inserting the ignition key into the ignition lock and turning the ignition key to a certain position". This prevents unintentional (re-)initializations with a particularly high degree of probability.

After receiving the fragment or the entire original code, a display fitted in the receiver indicates the completeness of the reception. This makes it easier for the operator to gain the certainty that the (re-)initialization is satisfactorily completed.

After succeeding in the (re-)initializing, the receiver briefly actuates the mechanism, that is for example the motor vehicle central locking system, in a perceptible way as acknowledgement. This makes it easier for the user to gain a particularly high degree of certainty that the (re-)initialization is satisfactorily completed, to be precise even if there is no particular other display, for example a small lamp, fitted on the receiver for this purpose.

A transmitter operator control element which has to be actuated for transmitting the original code, and/or for final storing of the original code or starting code in the transmitter memory, is a mini-button recessed into the transmitter housing and is only able to be actuated with a pointed implement. This increases (further) the level of security against erroneous (re-)initializations, in particular also to avoid unintentional (re-)initializations.

The transmitter contains a clock and/or accounter, in order to count the overall duration and/or the number of repeated transmission of the original code or its fragments, and the clock and/or the counter prevents the transmissions as soon as a maximum time and/or maximum number of transmissions has been exceeded. This increases the level of security against unintentional (re-)initializing, also against unauthorized listening in to the original code, as soon as the original code has been transmitted completely and sufficiently often.

After appropriate actuation, the transmitter allows at least one of its transmitter operator control elements to prevent the further transmitting of the original code.

This increases (still further) the level of security against unauthorized listening in to the original code.

During (re-)initializing, non-conformity with the stipulated clock, non-conformity with the durations stipulated by the clock or the numbers of transmissions stipulated by the counter have the effect that the previously generated and/or previously generated and/or previously transmitted fragments, of the original code is or are no longer used for making an original code. Instead only the previous original code or starting code, or else a continuation code derived therefrom in the meantime, continues to be used by the transmitter and by the receiver for the next codes to be transmitted in normal operation for actuation of the mechanism, provided that such an original code or starting code has been generated in it or entered into it beforehand in the first place. This increases further the level of security against erroneous (re-)initializations and to permit, in particular even after erroneous re-initializations, satisfactory further operation of the transmitter-receiver system by the authorized user on the basis of the previously valid initialization.

The transmitter contains a conversion unit, by means of which the transmitter enciphers the original code or its fragments, in order to transmit the original code in enciphered form, and the receiver contains a conversion unit, by means of which the receiver forms from the coded signal received the undeciphered original code or the starting code. This makes it more difficult for an unauthorized third party listening in to the transmitted original code to generate a code simulating authorization, namely an original code, starting code or (in the case of a changing code) a corresponding later, in fact authorizing continuation code, that say in particular to increase the level of security against theft.

The transmitter and the receiver each contains a logic unit which in normal operation calculates from case to case the next code to be transmitted on the basis of one of a plurality of algorithms. The calculated code in each case being one from the set of codes allowed, and the original code includes not only a specification of the starting code to be used in the future, but also a specification of the alternative of the algorithm to be used in the future. This makes it more difficult to imitate or calculate or guess authorizing starting codes or continuation codes.

The random generator contained in the transmitter is a counter unit or a unit of a computer operating as a counter. Upon appropriate actuating of at least one of its operator control elements the unit quickly counts repeatedly from zero to a high number (thus, for example, up to the number 255) and repeats this counting for as long as and as often as it takes until, by an appropriate actuation of the operator control element(s) concerned, in keeping with the stipulated unrhythmical clock (for example by releasing at the right time) the counting result then reached is generated as a fragment of the original code or starting code. This allows with relatively little outlay to generate a plurality of in each case very arbitrary random numbers, in order to form therefrom the very long original code to be transmitted to the receiver.

The duration of a single counting cycle from zero to zero amounts to one tenth of a second at most, and the maximum duration of the time period concerned, and consequently the maximum duration which is allowed for the generation of a fragment and consequently for the corresponding actuation of at least one operator control element concerned, amounts to ten seconds at most. This allows in a particularly user-friendly way, to shorten the duration of the (re-)initialization operation.

In normal operation, when transmitting its respective code for use of the object, the transmitter has a relatively high transmitting power, but, when (re-)initializing the original code or codes transmitted, or at least parts thereof, the transmitter transmits with a comparatively reduced transmitting power that, during this (re-)initializing, the transmitter must be at a very much smaller distance from the receiver than during normal operation. This offers a particularly high level of security against unauthorized listening in to the transmitted original code (fragments) by unauthorized third persons.

In the transmitter, the transmitting element is operated in normal operation from a power (output) stage with relatively high power, and consequently with relatively high operation current. However, in (re-)initialization operation it is operated with the relatively low operating current of the display. This makes the prohibited listening in by outsiders during (re-)initializing difficult with particularly little outlay.

The transmitter is an electronic motor vehicle key, the receiver is installed in or on a motor vehicle, the receiving element of the receiver is fitted in the interior of the motor vehicle, and the reduced power used for (re-)initializing is too low to be able with the motor vehicle locked to (re-)initialize the receiver from outside the motor vehicle. This increases greatly the level of security against unauthorized listening in to the transmitted original code (fragments) by unauthorized third parties in the case of a transmitter-receiver system of a motor vehicle.

The transmitter transmits an original code to a plurality of receivers for (re-)initialization of the receivers concerned. This provides to use a single transmitter simultaneously for a plurality of receivers, for example for receivers in a motor vehicle and on a garage door as well as in a house door, that is to be able to avoid a multiplicity of transmitters for receivers of different objects.

The receiver receives a different original code in each case from different transmitters.

This provides to use a single receiver simultaneously for a plurality of transmitters, for example for the multiplicity of transmitters/keys of a plurality of authorized users of a motor vehicle. This is to avoid a multiplicity of receivers in the object for the various users in particular when the receiver can be initialized by each individual one of the transmitters by means of in each case an original code individually assigned to only one transmitter concerned, by the receiver storing separately the various original codes of the various transmitters, or codes individually derived therefrom, and using them separately for determining user authorization.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
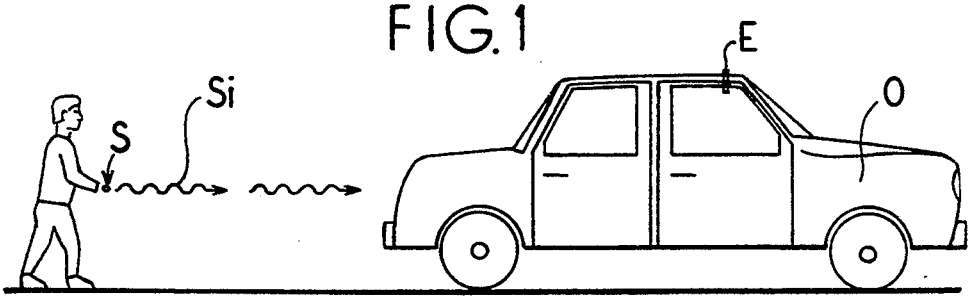
FIG. 1 shows a user actuating a transmitter, as well as an object/motor vehicle in which a receiver is fitted, which is to be controlled by the transmitter, the transmitter-receiver system having to be initialized or re-initialized beforehand, FIG. 2 diagrammatically shows a transmitter and an associated receiver of the system according to the invention.
Figure 2:
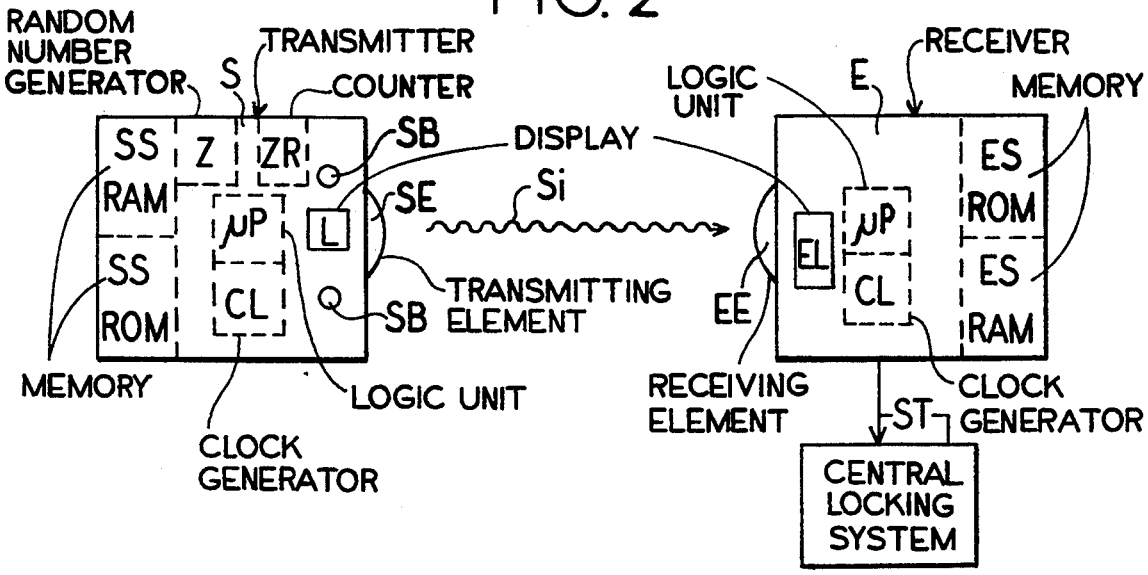

FIG. 2 shows by way of example and diagrammatically important components of a receiver E as well as a transmitter S, which according to FIG. 1 a user is holding in his hand, for remote control of the receiver E fitted in a motor vehicle O, and consequently for actuation of the central locking system ST of the motor vehicle O.

The transmitter S is in this case an electronic motor vehicle key S, which contains a transmitting element SE transmitting waves, for example a VHF antenna, an ultrasonic radiator and/or an infrared radiator. The motor vehicle key S contains, by way of example, two buttons SB as transmitter operator control elements SB, which for their part can trigger the transmitting (serial in the case of the example) of coded signals SI. The code of these signals SI indicates the authorization for use of the motor vehicle. This transmitter S further contains at least a single ROM and/or RAM as transmitter memory SS for the storage of data on use authorizations, that is for example for storing directly the start code or the continuation codes SI which is/are to be transmitted to the receiver E in normal operation (unless (re-)initializing). If a changing code is used, for example a changing code linked to the time of day The transmitter memory SS is provided for the storage of values ultimately correlating with the last transmitted original code and/or continuation code (and possibly for the storage of bits of program steps of the associated algorithm). From such data or correlating values, a logic unit, for example a program-controlled microprocessor $\mu$P, in each case calculates the starting code or (in the case of a changing code) the next continuation codes SI proving authorization.

The receiver E fitted underneath the motor vehicle roof contains, inter alia, a receiving element EE, for example an ultrasonic microphone and/or an infrared photodiode, see FIG. 2, in order consequently to be able to receive the transmitted coded signals SI. A receiver memory ES serves here for the storage of data (possibly also for the storage of bits of data representing program steps) the data stored in the receiver memory and the data stored in the transmitter memory correlating, in order that the receiver E can determine authorization or non-authorization from codes SI received. For this reason, a logic circuit, for example likewise a program-controlled microprocessor $\mu$P, checks the respectively received code SI by means of the data stored in the receiver memory ES, after which, depending on the result of the check, this logic circuit $\mu$P actuates or does not actuate a mechanism ST, namely in this case the motor vehicle central locking system ST and/or, for example, also a motor vehicle break-in alarm system ST.

It must be possible for such transmitter-receiver systems (in particular if they use a changing code) to be initialized, later perhaps even occasionally re-initialized, i.e. initially a matching has to be carried out, or else occasionally later a rematching, between a code SI transmitted in future by the transmitter S and the code SI accepted in future as authorized by the receiver E.

For this (re-)initialization, in the case of the invention an original code UC is transmitted from the transmitter S to the receiver E, see FIGS. 1 and 2, which code for its part either establishes the starting code SC, that is the first code SC authorized in future (or, if a changing code is used for the normal transmissions SI, establishes the set of various future authorized continuation codes SI=the authorized set of codes SI) including the starting code SC, that is the first usable code SC of the set SI.

This transmitted original code UC and/or a code formed from it in the receiver E by converting, that is for example a starting code SC formed by converting, is thus stored as data (as a rule of an identical type) not only in the transmitter memory SS but indeed also in the receiver memory ES.

In the case of the invention, the original code UC is transmitted undirectionally from the transmitter S to the receiver E, that is without any dialog taking place automatically and bidirectionally between the transmitter S and the receiver E.

In the case of the invention, the transmitter S additionally contains for preparation of the new future starting code/set of codes SI (and to be accepted in future by the receiver) a random generator Z, which in each case generates a random number by actuation of at least one of the transmitter operator control elements SB.

In the case of the system according to the invention, the user of the transmitter S can thus initialize and re-initialize the system in a very simple way by appropriate actuating of transmitter operator control elements SB, although the technical outlay, in particular for the random generator Z is low, and although no automatic dialog is required between the transmitter S and the receiver E and accordingly no outlay is required for an auxiliary receiver in the transmitter S for (re-)initializing. In principle, in spite of the simplicity of operator control and technical design of the invention, it is also not necessary in every case to use additional special devices, not even on the part of the selling motor vehicle dealer, in order to initialize completely the transmitter-receiver system for the first time, or later once again.

The transmitter S thus contains a random generator Z, which forms in one operation as a complete code (or in stages) the original code UC to be transmitted, or a (new) code or fragments of the new code, from which the original code UC to be transmitted is only formed by converting. This code itself, generated by the random generator Z, or a code subsequently derived therefrom in the transmitter S by conversion/enciphering, is transmitted as original code UC to the receiver E, the latter, in analogy with operation in the transmitter S, using this original code UC directly, or a code derived from it by an algorithm, as starting code SC.

The outlay for the random generator Z is particularly small, even if a very long original code UC is transmitted. This is true if the random generator Z successively generates a plurality of random numbers which in each case represent fragments B . . . , from which the original code UC is formed, see the original code time slot diagram example in FIG. 3 with the fragments B1, B2, . . . This is also true if the random generator Z generates in stages, for example by repeated actuating of at least one of the operator control elements SB, to be precise preferably in a specific rhythm stipulated by a clock generator CL, all the fragments B . . . required for the original code transmission.

The logic unit μP fitted in the transmitter S converts the generated fragments B on the basis of an algorithm into the original code UC to be transmitted, for example by simple chronological sequencing of the generated fragments B, or, still better, by chronological interleaving of the fragments B (for example according to Figure 3,) and/or by a complicated logic/algebraic operation on the generated bits of the fragments B.

The original code UC thus formed (or the starting code SC formed therefrom) is thus based on a plurality of, that is at least two fragments B interleaved or not interleaved with one another, and/or logically/algebraically combined or not combined with one another, in each case generated in themselves by means of the random generator Z and each for their part comprising, for example, eight bits.

Because, in the case of this further development of the invention, the more or less long (for example 64-bit long) original code UC or starting code SC can be formed from any number of fragments B . . . of any length by means of the random generator Z contained in the transmitter S (for example from 8 fragments, which for their part each comprise, for example, 8 bits) the level of security against unauthorized use of the object/motor vehicle can be advantageously made all the greater the more complicated, that is also the longer, the original code UC to be transmitted and the starting code SC correlating with it is, although it is possible for this to use just one small random generator Z, which is capable of generating in each case only small fragments B . . . of relatively few bits.

Reliable operator prompting can be achieved by a further development which (in particular if the clock pulse is very irregular) also safeguards against an original code being transmitted from the transmitter unintentionally by chance actuations of the operator control element(s). For this purpose, a display L, for example a small lamp L or a power-saving LCD display L, controlled by a clock generator CL, is fitted, which display stipulates for operator prompting during initializing or re-initializing a clock for actuation (for example for pressing and/or releasing) the transmitter operator control element(s) SB concerned, in order during these clocks to generate by stages the fragments B (and consequently finally the original code UC or starting code SC) by means of the random generator Z and by means of the logic circuit μP processing the fragment B.

If the original code UC is based on at least three (that is for example on five or eight) fragments B of in each case a plurality of for example at least eight bits, and if, in addition, the clock generator CL and consequently the display L in the transmitter S, or a clock generator CL and a display EL in the receiver E, stipulates in an uneven clock those time periods in which a fragment B can be generated and/or transmitted by means of appropriate actuation of the operator control element(s) concerned, the level of security is increased that no unauthorized person (for example children playing!) and even no authorized user inadvertently generates fragments, and consequently an original code, if he inadvertently actuates appropriate transmitter operator control elements. It also being possible by this measure for a not too small minimum number of actuations necessary for (re-)initialization to be stipulated.

This security against unauthorized or unintentional misoperations of the transmitter operator control elements SB can be further increased by the fact that the time period stipulated in each case by the clock generator CL during which the transmitter operator control element(s) SB concerned have to be operated for random number generation does not begin immediately with the appearance of the display L or EL but only later. The level of security against those misoperations is thus increased by the fact that the time periods unevenly stipulated the clock generator CL for the actuation of the operator control elements SB by means of the display L or EL in each case do not begin until after a stipulated delay, known by the authorized user (of for example one or two seconds) after the appearance of the display L or EL. In addition that these time periods are additionally limited by this clock generator CL (or by a further clock generator) to a maximum duration of for example three seconds.

If the transmitter operator control element(s) concerned is/are incorrectly operated, in this case the generation of the original code UC or of the starting code SC is preferably aborted. In this case possibly any generation of a fragment is additionally prevented for a certain duration, for example for 10 minutes, by means of a timing element.

In addition, the transmitter S can store either the various generated fragments B directly (or one or more values formed from these fragments B according to an algorithm) for the later establishment of a new code/set of codes SI in its transmitter memory SS, in order to transmit by means of these fragments B or values, as need be, the original code UC formed therefrom, started by an appropriate actuation of at least one of its transmitter operator control elements SB. As a result, all the preparations for transmitting the original code can be made by the user quite incidentally and gradually, even during normal actuations of the central locking system ST, or of any mechanism ST, see FIG. 2, in order to be able later as need be to transmit the original code quickly and completely to the receiver.

The level of security against unauthorized listening in to the transmitted original code can also be increased by an authorized third party being able to listen in at most to parts of the original code, of little use to him, but not readily to the entire original code. For this purpose, the original code UC can be transmitted in stages and each stage triggered by actuation of the transmitter operator control element(s) SB concerned.

Figure 3:
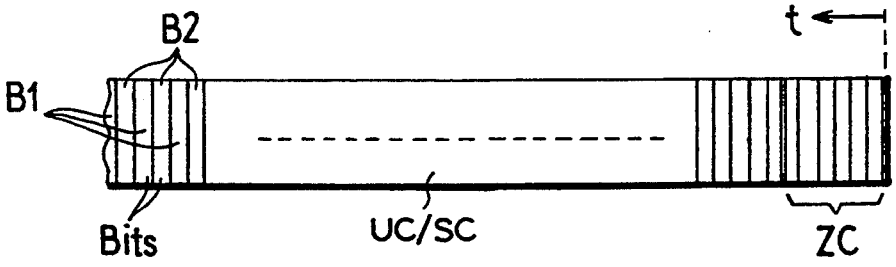
FIG. 3 shows a diagram of the time slots for transmission of the original code, together with an example of the time slots for transmitting an additional code, which indicates/signals to the receiver that there is a (re-)initialization, in other words that it is not a normal transmission of a starting code or continuation code, instead of a (re-)initialization.

Incidentally, the transmitter S can also be designed and operated in such a way that, with appropriate actuation of at least one of its transmitter operator control elements SB, it transmits the original code UC as a complete code in a single block, see also FIG. 3. As a result, the level of security against misoperations of the transmitter can be increased, also increasing the degree of probability that, depending on the standard used, at least all 1-bits of the original code, if not also the 0-bits, are transmitted with approximately the same power to the receiver E.

In order to make it easier for the user to gain the certainty from an acknowledgment that the (re-)initialization is satisfactorily completed, the display L, fitted in the transmitter S, or a further display EL, fitted for example in the receiver E, can indicate (for example by flashing) that all the fragments B have been generated and transmitted.

In the case of a further development of the invention, the transmitter operator control element SB used for generating and the transmitter operator control element SB used in normal operation for transmitting the starting code or a continuation code are identical (that is, instead of the two transmitter operator control elements SB shown in FIG. 2, there is, for example, only a single element) so that then with each actuation of the transmitter operator control element SB concerned a fragment B is in each case newly generated. In addition, then the respectively generated fragment B is buffer-stored in reserve (as such or code-converted) in the transmitter memory SS, for example in its RAM, before a next actuation of the transmitter operator control element SB concerned. As a result, the outlay on operator control elements SB as well as the effort by the user for preparation of a re-initialization can be reduced, by greatly deviating random numbers being obtained as fragments which can be used later already during normal operation, in which the duration and number of actuations of the transmitter operator control elements SB are in each case quite arbitrary. In this case, in particular also whenever a re-initialization should be carried out later in very great haste, the time required for preparing the re-initialization is avoided and consequently the level of security against unauthorized listening in is increased even in such cases of haste.

If the transmitter memory SS contains only one RAM, in the event of a battery change (the transmitter S usually requires a battery) a new initialization is always necessary before the system can operate again normally. If, on the other hand, the transmitter S contains (at least in addition to a RAM) for example also a ROM, for example an EEPROM, as transmitter memory SS, a re-initialization in the case of a battery change can also be avoided.

The functional reliability of the transmitter-receiver system during (re-)initializing can be increased by there being added to the original code UC transmitted a more or less long additional code ZC (for example only six or perhaps even far in excess of forty particular additional bits ZC) indicating initializing or re-initializing, in order to inform the receiver that then an original code UC is being transmitted. This additional code ZC can be transmitted, for example according to FIG. 3, directly before the original code UC.

If a fragment B of the original code UC or the entire original code UC is transmitted directly together with the additional code ZC, the reliability and simplicity of operator control during (re-)initializing is increased, inter alia because the power with which the individual bits or 1-bits of the original code are transmitted is then approximately equally great.

This additional code ZC, already mentioned above, can also be entered itself in the transmitter and receiver concerned of the system, for example by the dealer, as an additional code ZC which varies from system to system but is then fixed for the system concerned, for example in order to increase the level of security against unauthorized (re-)initializations, and consequently against theft. This additional code ZC, assigned individually to the system at the beginning as a fixed code, allows the system to be re-initialized later by means of the random generator in a way according to the invention, it no longer being possible for outsiders with their different transmitters to initialize the system in a prohibited way and then as it were also actuated in normal operation, because of a lack of identity of their additional code ZC.

The outlay on components can also be reduced—in particular if a display is already fitted in any case for other reasons, for example a power-saving LCD display on the transmitter, for example in order to indicate its operational readiness by the clock generator CL and the display L being fitted in the transmitter S, see FIG. 2, and by the display L stipulating with which clock the fragments B are to be generated in stages.

However, whenever the clock generator CL and the display EL are fitted in the receiver E and the display EL stipulates with which clock an original code fragment B is in each case to be transmitted in stages by actuation of the transmitter operator control element(s) SB concerned, the weight and the outlay for fitting a display in the transmitter S can be avoided and, in addition, shared use can often be made of a display already fitted on the receiver for other reasons, for example the display of a theft alarm system. Moreover, the menu prompting of the person carrying out the (re-)initialization, performed by the receiver E instead of by the transmitter S, then allows the degree of probability to be very small that the system is inadvertently (re-)initialized, by for example the operator control elements SB being inadvertently operated by children in a rhythm which is stipulated by the display/by the small lamp L of the transmitter S. Unintentional (re-)initializations of the system are avoided particularly reliably if the receiver E is ready to receive the original code UC only if the operator concerned has additionally performed another measure. For example, in addition he may have to insert the ignition key into the ignition lock and turn it to a certain position in order for the receiver E to be ready in the first place to receive the original code UC.

It can be made easier for the operator to gain the certainty that the (re-)initialization is satisfactorily completed if, after receiving the fragment or the entire original code UC, a display EL fitted in the receiver E clearly indicates this reception, that is clearly acknowledges irrespective of whether this display EL previously stipulated the clock for generation of the fragments B or not.

It is also made easier for the user to gain the certainty that the (re-)initialization is satisfactorily completed if, after succeeding in the (re-)initializing, the receiver E briefly actuates the mechanism ST (that is to say for example the motor vehicle central locking system ST) in a perceptible way as acknowledgment, to be precise even if no particular other display, such as for example a small lamp, is fitted on the receiver for this purpose.

The level of security against erroneous (re-)initializations can be increased, in particular unintentional (re-)initializations can also be avoided, if a transmitter operator control element SB which has to be actuated for transmitting the original code UC (and/or for final storing of the original code UC or starting code SC in a transmitter memory SS) is a mini-button SB recessed into the transmitter housing S and is only able to be actuated with a pointed implement.

The transmitter S may contain a clock and/or a counter ZR, in order to count the overall duration and/or the number of repeated transmissions of the original code UC or its fragments B. In this case, the clock and/or the counter ZR can prevent the transmissions as soon as a maximum time and/or maximum number of transmissions has been exceeded. As a result, the level of security against unauthorized listening in to the original code can be further increased, because the transmission is forcibly ended as soon as the original code has been transmitted completely and sufficiently often.

The level of security against unauthorized listening in can be still further increased if, after appropriate actuation, the transmitter S allows at least one of its transmitter operator control elements SB to prevent the further transmitting of the original code UC.

In the case of a further development of the invention, during initializing or re-initializing, non-conformity with the stipulated clock, and/or non-conformity with the durations stipulated by the clock or the numbers of transmissions stipulated by the counter ZR have the effect that the previously generated and/or previously transmitted fragment B, or the previously generated and/or previously transmitted fragments B, of the original code UC is or are no longer used for making up an original code UC. Instead, then only the original code UC or starting code SC valid previously or earlier, or else a continuation code SI derived therefrom in the meantime, continues to be used by the transmitter S and by the receiver E for the next codes SI to be transmitted in normal operation for actuation of the mechanism ST, provided that such an original code UC or starting code SC had been generated in it or entered into it beforehand in the first place. As a result, the level of security against erroneous (re-)initializations is further increased and, in particular, satisfactory continued operation of the transmitter-receiver system is made possible even after erroneous re-initializations.

It is made even more difficult for an unauthorized third party listening in to the original code transmitted to generate a code simulating authorization, namely an original code, starting code or (in the case of a changing code) a later continuation code, that is to say to increase in particular the level of security against theft, if the transmitter S contains a conversion unit $\mu$P, by means of which the transmitter S enciphers the original code UC or its fragments B) (possibly together with the additional code ZC) in order to transmit the original code UC in enciphered form, and if the receiver E also contains a conversion unit $\mu$P, by means of which the receiver E forms from the coded signal SI received the undeciphered original code UC or the starting code SC.

If the transmitter S and the receiver E each contains a calculating unit $\mu$P which in normal operation calculates from case to case the next continuation code SI to be transmitted on the basis of one of a plurality of algorithms possible in principle, this calculated code SI in each case being one from the set of codes SI allowed, and if in addition the original code UC includes not only a specification of the starting code SC to be used in future, but also a specification of the alternative of the algorithm to be used in future, it is made even more difficult for an unauthorized third party to imitate or calculate or guess authorizing continuation codes SI.

A plurality of, in each case very arbitrary, random numbers can be generated with relatively little effort, to form therefrom the very long original code to be transmitted to the receiver, if the random generator Z contained in the transmitter S is a counter unit or a unit of a computer $\mu$P operating as a counter. Upon appropriate actuating of at least one of its operator control elements SB, this unit quickly counts repeatedly from zero to a high number thus, for example, up to the number 255, repeating this counting for as long as and as often as it takes until, by an appropriate actuation of the operator control element(s) SB concerned, in keeping with the stipulated unrhythmical clock (for example by releasing at the right time) the counting result then reached is generated as fragment B of the original code UC or starting code SC.

If the duration of a single counting cycle from zero to zero amounts to one tenth of a second at most, and if at the same time the maximum duration of the time period concerned, and consequently the maximum duration which is allowed for the generation of a fragment B and consequently for the corresponding actuation of at least one operator control element SB concerned, amounts to ten seconds at most, it is possible in a particularly user-friendly way to shorten the duration of the (re-)initialization operation, without running a high risk that the generated fragment B is no longer a very arbitrary random number.

In DE-OS(A) 29 09 134 (corresponding to U.S. Pat. No. 4,881,148) it is already known in the case of a transmitter-receiver system constructed similarly to the invention to use different power levels for the transmissions when locking and unlocking the doors of a motor vehicle. There the aim is still to actuate the doors reliably even if the functional capability of the system in locking and unlocking, that is to say in normal operation, deteriorates, for example owing to aging of the battery.

A further development of the invention likewise uses two different power levels for transmitting the codes, but in other operating cases. For transmitting the original code UC, or fragments of the original code UC, a very much lower power level is used during unidirectional (re-)initializing than during normal operation. In normal operation, that is for transmitting the code SI, for example in order to actuate the door lock of the motor vehicle (for example when transmitting a continuation code SI if a changing code is being used) in the case of the further development of the invention a relatively high power is used for transmitting the code SI. As a result, for example if the object O is a motor vehicle and if the transmitter-receiver system is a system with an electronic key S and with a receiver E fitted in or on the motor vehicle O, the codes SI can be transmitted in normal operation, for example for opening and locking the motor vehicle doors, at such high power that these actuations of the door locks are also possible from a relatively great distance, away from the car. If, on the other hand, the system is to be (re-)initialized, the original code UC, or at least parts/fragments of this original code UC, are transmitted only with relatively low power, namely with such low power that an unauthorized third party can no longer listen in to these weak code signals from a relatively great distance.

Instead of the reduction in transmitting power during (re-)initializing (or in addition to this reduction) it is also possible to reduce the receiving sensitivity of the receiver E during (re-)initializing (for example after receiving the additional code ZC) to such an extent that the receiver E can as a rule then only be (re-)initialized by a transmitter S which is held very close to the receiver E (for example inside the motor vehicle O, right up near to the receiver E).

The transmitting power of the transmitter S, and similarly the sensitivity of the receiver E, can be reduced with particularly little outlay by fitting in the transmitter S and/or in the receiver E in series with the transmitting element SE or in series with the receiving element EE, respectively, a resistor which is only not bridged during (re-)initializing. This can be a small lamp L indicating this operating mode. In normal operation, on the other hand, this series-fitted resistor is bridged.

It is also possible, however, to reduce the transmitting power during (re-)initializing (in addition or else on its own) by operating the transmitting element SE in the transmitter S in normal operation from a power stage or power output stage with relatively high power, that is to say relatively high operating current, but operating this transmitting element SE in (re-)initialization operation with the relatively low operating current of the display L fitted in the transmitter, for example an LED display L.

If use is made of a transmitter-receiver system in which the transmitter S is an electronic motor vehicle key S, and in which the receiver E is installed in or on the motor vehicle O, in which in addition the receiving element EE of the receiver E is fitted inside the motor vehicle O, it is particularly favorable to reduce the transmission power during (re-)initializing, that is to say for transmitting the original code UC, or for transmitting fragments of this original code UC, to such an extent that, with the motor vehicle O locked, (re-)initializing from outside the locked motor vehicle O is no longer possible with this power. Thus, (re-)initializing is then only possible if the transmitting element SE of the electronic key S is held close enough to the receiving element E of the receiver E from inside the motor vehicle O. As a result, the level of security against unauthorized listening in by third parties during initializing is particularly high.

A transmitter S can also transmit its original code UC to a plurality of receivers E for (re-)initialization of these receivers E. Then, for example, a single electronic key S/transmitter S can be used simultaneously for a plurality of locking mechanisms. Thus, the same key can then (re-)initialize, for example, the receiver E in a motor vehicle O, as well as another receiver E on a garage door (O), and also a further receiver, for example on a house door, after which all these locking mechanisms can be actuated remotely with the same key and in principle with the same security and lack of complication as if only a single receiver E were being used.

It is also possible, however, for a plurality of different transmitters S to transmit their respective original code UC, assigned individually to them, to a single receiver E for (re-)initialization of this receiver E. Then, for example, a plurality of different electronic keys S/transmitters S can be used for just one receiver E (for example in a motor vehicle O) for a single locking mechanism common to all the transmitters. Then, these various keys S can thus (re-)initialize for example the receiver E in a motor vehicle O and subsequently each transmitter S can on its own remotely control the receiver E. The receiver E can, namely, store instead of a single original code UC or instead of just the data derived from this single original code UC also in addition the original codes UC (or data derived in each case therefrom) in its receiver memory ES. Each transmitter S (re-)initializes and then thus controls the receiver E independently of the other transmitters S. It may also be provided that then the above mentioned additional code ZC has to be identical for all the transmitters S, in order that no other transmitters S of unauthorized persons can (re-)initialize the receiver E.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A transmitter-receiver system for checking authorization to use an object; comprising:

a transmitter having a transmitting element and a first transmitter operator control element which triggers the transmitting of coded signals by the transmitting element, the coded signal representing a code concerning the authorization to use the object, and the transmitter also having at least one transmitter memory for storage of data regarding the coded signals representing the coded concerning the authorization to use;

a receiver, having a receiving element which receives the coded signals from the transmitter, having a receiver memory for storage of data for determining authorization or non-authorization of the codes received in the coded signals, and having a logic unit, which checks the received code with the data stored in the receiver memory and, depending on the result of the check, actuates a mechanism on the object;

in (re-)initialization of the system for at least one of matching and rematching a new code transmitted by the transmitter to a code authorized by the receiver, the transmitter having for preparation of the new code a random generator, which generates a random number by actuation of a second transmitter operator control element;

an original code, which establishes one of a starting code and a set of various new codes including the starting code using at least one of the transmitted original code, data formed in the receiver from the original code, and data formed in the transmitter from the original code, the original code being stored in the transmitter memory or in the receiver memory, wherein the random generator generates a random number that is indicative of only a fragment of the original code and, by further actuations of the second operator control element, produces in stages all fragments of the original code, the transmitter having a logic unit for converting the generated fragments into the original code, the original code or starting code being established from at least three fragments derived from random numbers generated by the random generator, and the original code being transmitted unidirectionally from the transmitter to the receiver without any dialogue taking place automatically and bidirectionally between the transmitter and the receiver.

2. The transmitter-receiver system as claimed in claim 1, wherein the system further comprises a display controlled by a clock generator, which display provides a visual prompt for operator prompting during (re-)initializing of a clock for actuation of the second transmitter operator control element, in order during operation of said clock to generate by stages the original code or starting code by means of the random generator.

3. The transmitter-receiver system as claimed in claim 2, wherein the clock generator provides uneven clock time periods, and the display provides the visual prompt in the uneven clock time periods during which a fragment is at least one of generated and transmitted by means of actuation of respective first and second operator control elements.

4. The transmitter-receiver system as claimed in claim 3, wherein the time periods begin after a predetermined delay after the visual prompt, and wherein the time periods are limited to a predetermined maximum duration.

5. The transmitter-receiver system as claimed in claim 1, wherein the transmitter stores at least one of the fragments directly and fragmental values indirectly, said fragmental values being formed from said fragments according to an algorithm, for establishing at least one of the new code and the sets of new codes in transmitter memory, in order to put together said fragments or values to form at least one of the original code and the starting code and the transmit the original code only after an appropriate actuation of the first transmitter operator control element.

6. The transmitter-receiver system as claimed in claim 1, wherein the original code is transmitted in stages, and each stage is triggered by actuation of the first transmitter operator element after generation of a respective fragment.

7. The transmitter-receiver system as claimed in claim 1, wherein with actuation of the first transmitter operator control element, the transmitter transmits the original code as a complete code in a block after generation of all respective fragments.

8. The transmitter-receiver system as claimed in claim 2, wherein the display in the transmitter and a display in the receiver both provide visual information that all the fragments have been generated and transmitted.

9. The transmitter-receiver system as claimed in claim 1, wherein the second transmitter operator control element is used for generating and wherein the first transmitter operator control element is used in normal operation for transmitting the respective code, so that with each actuation of the second transmitter operator control element a fragment is newly generated, and the respectively generated fragment is buffer-stored in the transmitter memory directly, before a next actuation of the second transmitter operator control element.

10. The transmitter-receiver system as claimed in claim 1, wherein in the transmitter an additional code indicating one of initializing and re-initializing, is added to the original code, in order to inform the receiver that an original code is being transmitted.

11. The transmitter-receiver system as claimed in claim 10, wherein one of a fragment of the original code and the entire original code is transmitted directly together with the additional code.

12. The transmitter-receiver system as claimed in claim 2, wherein the clock generator and the display are located in the transmitter, and wherein the display provides a visual prompt for selection of a clock with which the fragments are to be generated by stages.

13. The transmitter-receiver system as claimed in claim 2, wherein the clock generator is located in at least one of the transmitter and the receiver, and the display is located in the receiver, and wherein the display provides a visual prompt for selection of a clock with which an original code fragments is in each case to be transmitted in stages by actuation of the first transmitter operator control element.

14. The transmitter-receiver system as claimed in claim 13, wherein the receiver only carries out the (re-)initialization if an authorized person additionally carries out an additional measure.

15. The transmitter-receiver system as claimed in claim 2, wherein after receiving one of the fragment and the entire original code, a display in the receiver indicates a complete reception.

16. The transmitter-receiver system as claimed in claim 1, wherein after succeeding in the (re-)initializing, the receiver briefly actuates the mechanism as an acknowledgement.

17. The transmitter-receiver system as claimed in claim 1, wherein the at least one of the first and second transmitter operator control elements is a mini-button recessed into a transmitter housing of the transmitter and is only actuatable with a pointed implement.

18. The transmitter-receiver system as claimed in claim 1, wherein the transmitter contains a counter for counting at least one of the overall duration and the number of repeated transmissions of the original code or the fragments, and wherein the counter prevents transmissions as soon as one of a maximum time and maximum number of transmissions has been exceeded.

19. The transmitter-receiver system as claimed in claim 18, wherein after said transmitting of the original code, the transmitter prevents the first transmitter operator control element from effecting further transmitting of the original code.

20. The transmitter-receiver system as claimed in claim 1, wherein during (re-)initializing, at least one of non-conformity with the stipulated clock, non-conformity with the durations stipulated by the clock or the number of transmissions stipulated by the counter effect that at least one of the previously generated fragment and the previously transmitted fragment, or at least one of the previously generated fragments and the previously transmitted fragments, of the original code are no longer used for making up an original code, instead then only one of the previous original code, the starting code, or a continuation code derived therefrom, continues to be used by the transmitter and by the receiver for next codes to be transmitted in normal operation for actuation of the mechanism, provided that such an original code or starting code has previously been one of generated in and entered into the receiver.

21. The transmitter-receiver system as claimed in claim 1, wherein the transmitter has a conversion unit, by means of which the transmitter enciphers one of the original code and the fragments thereof, in order to transmit the original code in enciphered form, and wherein the receiver has a conversion unit, by means of which the receiver forms from the received coded signal one of the undeciphered original code and the starting code.

22. The transmitter-receiver system as claimed in claim 1, wherein the transmitter and the receiver each has a logic unit which in normal operation calculates from case to case a next code to be transmitted on the basis of one of a plurality of algorithms, the next code being one from the set of codes allowed, and wherein the original code includes a specification of the starting code to be used in the future, and a specification of an alternative algorithm to be used in the future.

23. The transmitter-receiver system as claimed in claim 1, wherein the random generator in the transmitter upon appropriate actuation of the second operator control element quickly counts repeatedly from zero to a high number and repeats this counting for as long as and as often as it takes until, by an appropriate actuation of the at least one operator control element, in keeping with a predetermined unrhythmical clock the counting result then reached is generated as a fragment of one of the original code and starting code.

24. The transmitter-receiver system as claimed in claim 23, wherein the duration of a single counting cycle from zero to zero amounts to one tenth of a second at most, and wherein the maximum duration of the respective time period, and consequently the maximum duration which is allowed for the generation of a fragment and consequently for the corresponding actuation of the at least one operator control element, amounts to ten seconds at most.

25. The transmitter-receiver system as claimed in claim 1, wherein in normal operation, when transmitting a respective code for use of the object, the transmitter has a relatively high transmitting power, and wherein when (re-)initializing one of the original code transmitted, codes transmitted, and at least parts thereof, the transmitter transmits with reduced transmitting power such that, during such (re-)initializing, the transmitter is required to be closer to the receiver than during normal operation.

26. The transmitter-receiver system as claimed in claim 2, wherein the display is in the transmitter, and wherein in the transmitter, the transmitting element is operated in normal operation from a power stage with relatively high power, and consequently with relatively high operating current, and in (re-)initialization operation the transmitting element is operated with a relatively low operating current.

27. The transmitter-receiver system as claimed in claim 25, wherein the object is a motor vehicle, wherein the transmitter is an electronic motor vehicle key, wherein the receiver is attached to the motor vehicle, wherein the receiving element of the receiver is fitted in an interior of the motor vehicle, and wherein the reduced transmitting power used for (re-)initializing is too low to be able to (re-)initialize the receiver from outside the motor vehicle.

28. The transmitter-receiver system as claimed in claim 1, wherein the system further comprises a plurality of receivers, and wherein the transmitter transmits an original code to the plurality of receivers for (re-)initialization of respective receivers of the plurality of receivers.

29. The transmitter-receiver system as claimed in claim 1, wherein the system further comprises a plurality of transmitters, and wherein the receiver receives a different original code from different transmitters of the plurality of transmitters.

30. The transmitter-receiver system as claimed in claim 1, wherein the transmitting element is at least one of a VHF antenna, an ultrasonic radiator and an infrared radiator.

31. The transmitter-receiver system as claimed in claim 1, wherein the receiving element is at least one of a VHF receiver, an ultrasonic microphone and an infrared photo-diode.

32. The transmitter-receiver system as claimed in claim 1, wherein the mechanism is a motor vehicle central locking system and wherein the object is a motor vehicle.

33. The transmitter-receiver system as claimed in claim 1, wherein the original code or starting code is derived from a plurality of fragments in the range of five fragments to eight fragments.

34. The transmitter-receiver system as claimed in claim 1, wherein each of the fragments has eight bits.

35. The transmitter-receiver system as claimed in claim 1, wherein the fragments are interleaved with one another.

36. The transmitter-receiver system as claimed in claim 1, wherein the fragments occur in sequence.

37. The transmitter-receiver system as claimed in claim 2, wherein the display is a small lamp.

38. The transmitter-receiver system as claimed in claim 2, wherein the actuation for (re-)initializing the clock occurs by at least one of pressing and releasing the second transmitter operator control element.

39. The transmitter-receiver system as claimed in claim 4, wherein the delay is one second and the maximum duration is three seconds.

40. The transmitter-receiver system as claimed in claim 9, wherein the generated fragment is buffer-stored in reverse.

41. The transmitter-receiver system as claimed in claim 9, wherein the generated fragment is buffer-stored by code-conversion.

42. The transmitter-receiver system as claimed in claim 10, wherein the additional code has six bits.

43. The transmitter-receiver system as claimed in claim 14, wherein the additional measure is engagement of an ignition key with an ignition lock of a motor vehicle and a rotation of the ignition key to a predetermined position, the object being a motor vehicle.

44. The transmitter-receiver system as claimed in claim 23, wherein the random generator counts repeatedly from zero to 255.

* * * * *